US007791283B2

(12) United States Patent
Suzuki

(10) Patent No.: US 7,791,283 B2
(45) Date of Patent: Sep. 7, 2010

(54) DISCHARGE LAMP LIGHTING APPARATUS

(75) Inventor: Shinichi Suzuki, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 159 days.

(21) Appl. No.: 12/084,422

(22) PCT Filed: Oct. 25, 2006

(86) PCT No.: PCT/JP2006/321269

§ 371 (c)(1),
(2), (4) Date: Jun. 30, 2008

(87) PCT Pub. No.: WO2007/052514

PCT Pub. Date: May 10, 2007

(65) Prior Publication Data

US 2009/0160355 A1 Jun. 25, 2009

(30) Foreign Application Priority Data

Nov. 2, 2005 (JP) ..... 2005-319543

(51) Int. Cl.
*H05B 37/02* (2006.01)

(52) U.S. Cl. ..... 315/224; 315/225; 315/226; 315/276; 315/291; 315/307

(58) Field of Classification Search ..... 315/209 R, 315/210, 219, 224, 225, 226, 244, 246, 250, 315/254, 276, 291, 307, 308, DIG. 5, DIG. 7
See application file for complete search history.

(56) References Cited

U.S. PATENT DOCUMENTS

| | | | | |
|---|---|---|---|---|
| 6,281,639 | B1 * | 8/2001 | Suzuki et al. | 315/291 |
| 6,680,585 | B2 * | 1/2004 | Trestman | 315/291 |
| 6,774,580 | B2 * | 8/2004 | Suzuki et al. | 315/224 |
| 7,515,446 | B2 * | 4/2009 | Lin | 363/98 |
| 2003/0057873 | A1 | 3/2003 | Suzuki et al. | |
| 2004/0113565 | A1 | 6/2004 | Fushimi | |

(Continued)

FOREIGN PATENT DOCUMENTS

JP A-62-229791 10/1987

(Continued)

*Primary Examiner*—Thuy Vinh Tran
(74) *Attorney, Agent, or Firm*—Oliff & Berridge, PLC

(57) ABSTRACT

There is provided highly efficient discharge lamp lighting apparatus capable of reducing its cost by reducing high withstand voltage components on the secondary side of a high voltage transformer and stabilizing, its circuit operation. A discharge lamp lighting apparatus (1) comprises a high voltage transformer (2), a switching circuit (4) for driving the primary side of the high voltage transformer (2), and a triangular wave generation circuit (15) for determining the operation frequency of the switching circuit (4). The triangular wave generation circuit (15) includes a frequency switching means (25) for switching the operation frequency of the switching circuit (4) between before and after the lighting of a discharge lamp (3). At the secondary side of the high voltage transformer (2), a resonant circuit having a capacitance component consisting of only a parasitic capacitance ($C_{CFL}$) is also formed. Before the lighting of the discharge lamp (3), the switching circuit (4) is operated at a frequency around the series resonance frequency of the resonant circuit on the secondary side. After the lighting of the discharge lamp (3), the switching circuit (4) is operated at a frequency around the frequency at which the phase difference between the voltage and the current on the primary side becomes minimum.

6 Claims, 4 Drawing Sheets

U.S. PATENT DOCUMENTS

| | | | | |
|---|---|---|---|---|
| 2004/0212319 | A1 | 10/2004 | Fushimi | |
| 2005/0007029 | A1 | 1/2005 | Fushimi | |
| 2005/0023990 | A1 * | 2/2005 | Suzuki | 315/276 |

FOREIGN PATENT DOCUMENTS

| | | |
|---|---|---|
| JP | A-2003-168585 | 6/2003 |
| JP | A-2003-309023 | 10/2003 |
| JP | A-2004-327327 | 11/2004 |
| JP | A-2005-038683 | 2/2005 |

* cited by examiner

DISCHARGE LAMP LIGHTING APPARATUS

This Application is a National Phase of PCT/JP2006/321269, filed Oct. 25, 2006, which claims the benefit of Japanese Patent Application No. JP2005-319543 filed Nov. 2, 2005. The disclosure of the prior applications is hereby incorporated by reference herein in its entirety.

TECHNICAL FIELD

The present invention relates to a discharge lamp lighting apparatus, and more specifically to a discharge lamp lighting apparatus for lighting a discharge lamp serving as a light source of a back light device for use in a liquid crystal display device.

BACKGROUND ART

Since the liquid crystal display utilized as a display device such as a liquid crystal monitor or a liquid crystal television device does not emit light by itself, it requires a lighting device such as a backlight device. As a light source for such a backlight device, a discharge lamp such as a cold cathode lamp is widely used. A high AC voltage necessary for lighting such a discharge lamp is usually obtained by boosting the output of an inverter circuit by a high voltage transformer.

Recently, a discharge lamp lighting apparatus has been proposed that has a series resonant circuit formed on the secondary side of a high voltage transformer and that has an H-bridge circuit for driving the primary side of the high voltage transformer at a frequency which is lower than the resonance frequency of the series resonant circuit, and at which a phase difference between voltage and current on the primary side of the high voltage transformer lies within a predetermined range from a minimum value (refer to Document Paper 1 for example).

FIG. 5 is a circuit block diagram showing such a discharge lamp lighting apparatus. In the discharge lamp lighting apparatus 100 shown in FIG. 5, on the secondary side of a high voltage transformer 101, a series resonant circuit is configured by a leakage inductance of the high voltage transformer 101, capacitors 131 and 132, and a parasitic capacitance 103 of a discharge lamp 109. The operating frequency of an H-bridge circuit 117 for driving the primary side of the high voltage transformer 101 is set to a frequency which is lower than the resonance frequency of this series resonant circuit, and at which the phase difference θ between voltage and current on the primary side of the high voltage transformer 101 lies within a predetermined range from a minimum value, whereby the high voltage transformer 101 attains enhanced power efficiency.

Here, the capacitors 131 and 132 connected to the secondary side of the high voltage transformer 101 function as auxiliary capacitances for the parasitic capacitance 103. By changing the capacitances of capacitors 131 and 132, the resonance frequency of the series resonance circuit formed on the secondary side can be set to a desired value. The capacitors 131 and 132 function also as voltage detecting means when the secondary side is open. A signal 133 of which the voltage has been divided by the capacitors 131 and 132 is inputted into an error amplifier 151 for voltage feedback, and an output voltage 152 from the error amplifier 151 is inputted into a protection circuit 150 and a PWM circuit 108. The protection circuit 150, when the output voltage 152 of the error amplifier 151 exceeds a predetermined threshold value, stops the operation of a logic circuit 129 to thereby prevent an overcurrent into the discharge lamp 109. To the discharge lamp 109, a current-voltage conversion circuit 110 for converting a tube current of the discharge lamp 109 is connected. An output voltage **109*a* of the discharge lamp 109 is inputted into an error amplifier 111, which outputs an output voltage 112 in accordance with a current of the discharge lamp 109 to the PWM circuit 108**, whereby constant current control on the basis of pulse width modulation is performed.

[Patent Document 1] Japanese Unexamined Patent Application Publication No. 2005-038683

DISCLOSURE OF INVENTION

Problems to be Solved by the Invention

However, in order to prevent an output overvoltage when the secondary side is open, such a conventional discharge lamp lighting apparatus 100 is configured so as to divide the voltage of a secondary side output of the high voltage transformer 101 by the capacitors 131 and 132, and to detect an open circuit voltage using the signal of which the voltage has been divided. Hence, for the capacitors 131 and 132, a high withstand voltage capacitor must be used, which has caused a problem of incurring a cost increase. In particular, in a large-sized liquid crystal display used for a display device for use in a liquid crystal television or the like, since a backlight incorporating a plurality of discharge lamps is used in order to attain a high brightness, the discharge lamp lighting apparatus requires capacitors 131 and 132 in accordance with the number of the discharge lamps, which exerts even more influence on the cost increase.

The present invention has been made in light of the above-described problems, and it is an object of the present invention to provide a highly efficient discharge lamp lighting apparatus that allows a cost reduction by reducing the number of high withstand voltage components on the secondary side of a high voltage transformer and that enables stabilization of its circuit operation.

Means for Solving the Problems

In order to solve the above-described object, there is provided a discharge lamp lighting apparatus comprising a high voltage transformer with a discharge lamp connected to a secondary side thereof, a switching circuit performing a switching operation based on a frequency of a triangular wave outputted from a triangular wave generation circuit so as to drive a primary side of the high voltage transformer, and a resonance circuit formed on the secondary side of the high voltage transformer in which its capacitance component is constituted of only a parasitic capacitance, wherein: the switching circuit in pre-lighting of the discharge lamp is made to perform switching operations at a frequency around a series resonance frequency of the resonant circuit on the secondary side; the switching circuit in post-lighting of the discharge lamp is made to perform switching operations at a frequency around which a phase difference between voltage and current on the primary side becomes minimum; triangular wave generation circuit has an oscillation frequency adjusted by a resistor and a capacitor, and is provided with a frequency switching means including a first resistor, a transistor, a second resistor connected to a collector of the transistor and inverter element connected to the base of the transistor; the frequency of the triangular wave generation circuit in an unlighted period of the discharge lamp is determined by the combined resistance of the first resistor and the second resistor connected in parallel to each other, and the capacitor connected to the triangular wave generation circuit; and the frequency of the triangular wave generation circuit in a lighted period of the discharge lamp is determined by the resistance of the first resistor and the capacitor connected to the triangular wave generation circuit.

According to the present invention, before the lighting of the discharge lamp, the switching circuit is operated at a frequency around the series resonance frequency of the resonant circuit formed on the secondary side of the high voltage transformer. After the lighting of the discharge lamp, the switching circuit is operated at a frequency around the frequency at which the phase difference between voltage and current on the primary side becomes minimum. As a result, before the lighting of the discharge, a necessary and sufficient high voltage can be achieved to thereby reliably light the discharge lamp, and after the lighting of the discharge lamp, the discharge lamp lighting apparatus can be operated in a frequency range within which the efficiency of the high voltage transformer becomes maximum.

Since the capacitance component of a resonant circuit formed on the secondary side of the high voltage transformer is constituted of only a parasitic capacitance on the secondary side, the high withstand voltage capacitor provided on the secondary side of the high voltage transformer becomes unnecessary. This allows a significant reduction in cost of the discharge lamp lighting apparatus, and reduces the risk of causing an arc discharge or the like by reducing places where a high voltage may occur on the secondary side of the high voltage transformer, thereby contributing to an improvement in quality of the discharge lamp lighting apparatus.

In one aspect of the present invention, the discharge lamp lighting apparatus further includes an error amplifier for setting an open circuit voltage. Herein, on the basis of a power source voltage inputted into the error amplifier and a predetermined reference voltage, the output voltage of the high voltage transformer at the time when the secondary side thereof is open is controlled. This allows a desired open circuit voltage to be obtained without the need for feedback from the secondary side of the high voltage transformer.

In the discharge lamp lighting apparatus, it is preferable that the switching circuit be either a full bridge circuit or a half bridge circuit, and that the series resonance frequency of the resonant circuit on the secondary side of the high voltage transformer be determined from a leakage inductance of a secondary winding and the parasitic capacitance.

Moreover, in the discharge lamp lighting apparatus according to the present invention, it is preferable that the discharge lamp be a cold cathode lamp, and that the discharge lamp lighting apparatus be used for a backlight device for use in a liquid crystal display device.

Advantages

As compared with the conventional discharge lamp lighting apparatus, the present invention with the above-described features can provide a highly efficient discharge lamp lighting apparatus that allows a cost reduction by reducing the number of high withstand voltage components on the secondary side of the high voltage transformer without adding new components to the primary side of the high voltage transformer, and that enables stabilization of its circuit operation.

REFERENCE NUMERALS

1 and 30 discharge lamp lighting apparatuses
2 and 40 high voltage transformers
3 discharge lamp
4 switching circuit
25 frequency switching means
$C_{CFL}$ parasitic capacitance
Np primary winding
Ns secondary winding

BEST MODES FOR CARRYING OUT THE INVENTION

Figure 1:
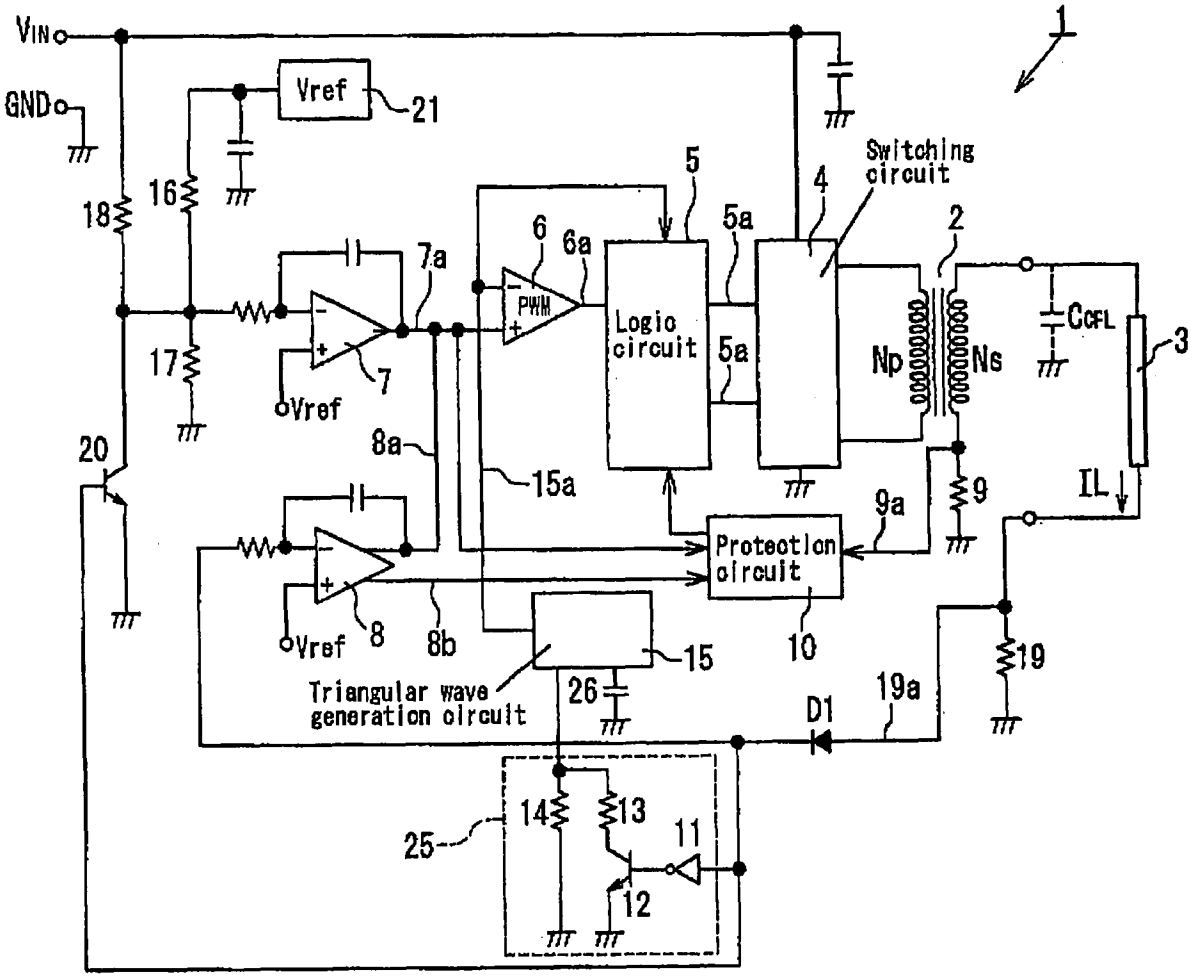
FIG. 1 is a circuit block diagram showing a discharge lamp lighting apparatus according to a first embodiment of the present invention.

Hereinafter, embodiments according to the present invention will be described with reference to the appended drawings. FIG. 1 is a circuit block diagram showing a discharge lamp lighting apparatus 1 according to a first embodiment of the present invention. As shown in FIG. 1, the discharge lamp lighting apparatus 1 according to the first embodiment includes a high voltage transformer 2 and a switching circuit 4 for driving the primary side of the high voltage transformer 2, and a discharge lamp 3 constituted of e.g., a cold cathode lamp is connected to the secondary side of the high voltage transformer 2. In this embodiment, the high voltage transformer 2 is a leakage flux transformer of which the secondary winding has a leakage inductance of at least 40 mH, preferably about 300 mH. As shown in FIG. 1, in the discharge lamp 3, one terminal thereof is connected to the secondary winding Ns of the high voltage transformer 2, and the other terminal thereof is grounded to GND via a lamp current detection resistor 19.

Here, the illustrated capacitor $C_{CFL}$ is a parasitic capacitance of the discharge lamp 3, and in the discharge lamp lighting apparatus 1 in this embodiment, a resonant circuit of which the capacitance component is constituted of a parasitic capacitance $C_{CFL}$ alone, is provided on the secondary side of the high voltage transformer 2.

Figure 2:
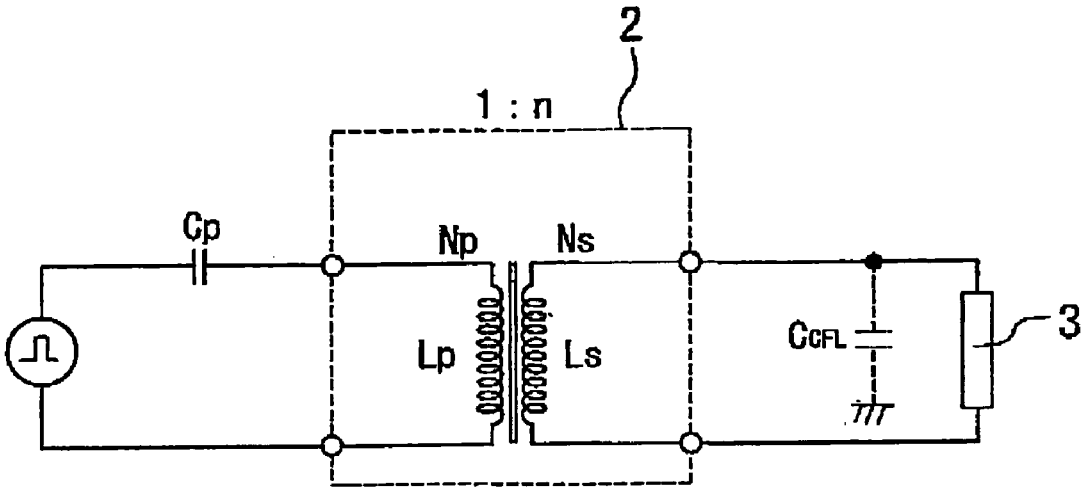
FIG. 2 is a circuit block diagram showing a high voltage transformer portion of the discharge lamp lighting apparatus illustrated in FIG. 1.

FIG. 2 is a circuit diagram showing the high voltage transformer portion 2 of the discharge lamp lighting apparatus 1. The turn ratio of a primary winding Np to the secondary winding Ns is defined as "n". In this embodiment, a resonance circuit having a specific resonance frequency is provided on the secondary side of the high voltage transformer 2, the resonance circuit being composed of a self inductance Ls of the secondary winding Ns of the high voltage transformer 2 and the parasitic capacitance $C_{CFL}$ of the discharge lamp 3.

Figure 3:
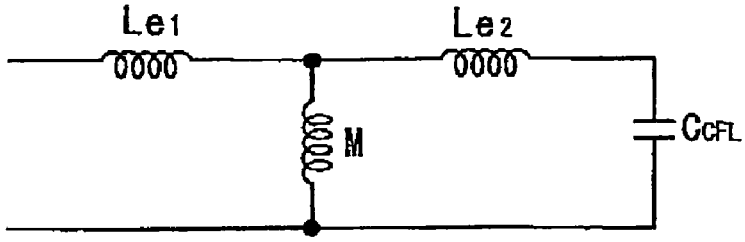
FIG. 3 is an equivalent circuit diagram showing a resonant circuit on the secondary side of the high voltage transformer illustrated in FIG. 2.

FIG. 3 is an equivalent circuit diagram showing a resonant circuit on the secondary side. Here, M denotes a mutual inductance of the high voltage transformer 2, and Le1 and Le2 each denote a leakage inductance. In such a resonance circuit, a series resonance frequency fss is determined from the secondary side inductance Le2 and the parasitic capacitance $C_{CFL}$ as follows:

$$fss=1/(2\pi\sqrt{(Le2\cdot C_{CFL})})$$

Also, a parallel resonance frequency fsp in this resonance circuit is determined from a self inductance Ls (Ls=M+Le2) of the secondary winding Ns and the parasitic capacitance $C_{CFL}$ as follows:

$$fsp=1/(2\pi\sqrt{(Ls\cdot C_{CFL})})$$

Next, referring again to FIG. 1, operations of the discharge lamp lighting apparatus 1 according to the present invention will be described. In the discharge lamp lighting apparatus 1, the switching circuit 4 is either a full bridge circuit in which two series circuit each composed of two switching elements (e.g., power MOSFETs) are connected in parallel to each other, or a half bridge circuit constituted of a series circuit composed of two switching elements. The on-off control of each the switching elements is performed by signals (gate signals) 5*a* outputted from a logic circuit 5. Here, the operating frequency for switching operations of the switching circuit 4 is determined based on the frequency of a triangle wave 15*a* outputted from a triangular wave generation circuit 15. The discharge lamp lighting apparatus 1 in this embodiment provides the triangular wave generation circuit 15 with a frequency changing means 25 that is composed of a first resistor 14, a transistor 12, a second resistor 13 connected to the collector of the transistor 12, and an inverter element 11 connected to the base of the transistor 12.

In the discharge lamp lighting apparatus 1 according to the present embodiment, there is provided an error amplifier 7 for setting an open circuit voltage, in addition to an error lamp 8 for setting a lamp current. The pulse width modulation control by a PWM circuit 6 is performed based on comparison of outputs 7*a* and 8*a* from the error amplifiers 7 and 8 with the triangle wave 15*a*. The on-duty of each of the switching elements constituting the switching circuit 4 is controlled by a pulse signal 6*a* from the PWM circuit 6.

Operations of the discharge lamp lighting apparatus 1 during unlighted period and during lighted period of the discharge lamp 3 will be detailed below. Description will first be made of the operation at the moment an input voltage $V_{IN}$ is switched on but the discharge lamp 3 is not yet lighted. In the discharge lamp lighting apparatus 1, a lamp current IL is converted into a feedback voltage signal 19*a* by the lamp current detection resistor 19 and inputted into the frequency changing means 25 via a diode D1. Since, immediately after the input voltage $V_{IN}$ has been switched on, the lamp current IL is not flowing, the output of the inverter element 11 of the frequency changing means 25 becomes a High level, thereby entering the transistor 12 into an on-state. As a result, a combined resistance of the first resistor 14 and the second resistor 13 connected to each other in parallel, is connected to the triangular wave generation circuit 15, so that the frequency of the triangle wave 15*a* is determined from the combined resistance and the capacitance of a capacitor 26. In the present embodiment, the frequency of the triangle wave 15*a* during the unlighted period of the discharge lamp 3 is set to be a frequency (hereinafter denoted as "fo") in the vicinity of the above-described series resonance frequency fss of the resonant circuit on the secondary side.

The feedback voltage signal 19*a* is applied also to the base of a transistor 20 via the diode D1, but since the lamp current IL is not flowing immediately after the input voltage VIN has been switched on, the transistor 20 is kept in an off-state. As a consequence, a voltage that is determined by the power supply voltage $V_{IN}$, a reference voltage Vref from a reference voltage circuit 21, and resistors 16, 17 and 18, is inputted to the inverting input terminal of the error amplifier 7 for open circuit voltage setting, and a predetermined set voltage 7*a* of the error amplifier 7 according to an error between the above-described voltage inputted into the inverting input terminal of the error amplifier 7 and the reference voltage Vref inputted to the non-inverting input terminal thereof, is outputted to the PWM circuit 6. The PWM circuit 6 compares the triangle wave 15*a* from the triangular wave generation circuit 15 with the output voltage 7*a*, and based on the comparison result, outputs a pulse signal 6*a* having a predetermined pulse width, to the logic circuit 5. Each of the switching elements of the switching circuit 4 is subjected to on-off control by the gate signals 5*a* outputted from the logic circuit 5, and the switching circuit 4 outputs a rectangular wave voltage to thereby drive the primary side of the high voltage transformer 2 at the frequency Fo around the series resonance frequency fss of the secondary side resonant circuit.

In this embodiment, the output voltage 7*a* from the error amplifier 7, determined by the reference voltage Vref from the reference voltage circuit 21, and the resistors 16, 17 and 18, is set so as to provide a desired open circuit voltage when the secondary side of the high-voltage transformer 2 is open. At that time, by operating the switching circuit 4 at the frequency fo, the open circuit voltage can be made sufficiently high one as a starting voltage of the discharge lamp 3 by virtue of the series resonance of the secondary side resonant circuit, which leads to reliable lighting of the discharge lamp 3. Meanwhile, during the unlighted period of the discharge lamp 3, the parasitic capacitance on the secondary side is substantially constituted of the parasitic capacitance generated between wiring lines and is assumed to have a smaller value than the capacitance $C_{CFL}$. Hence, the frequency fo, which is to be set to the vicinity of the series resonance frequency fss, is preferably set to a value higher than the series resonance frequency fss.

In the discharge lamp lighting apparatus 1 in this embodiment, since a symmetric signal is inputted into the switching circuit 4 based on a signal produced by the triangular wave generation circuit 15, a symmetric rectangular wave voltage is outputted from the switching circuit 4. By inputting this symmetric rectangular wave voltage into the primary side of the high voltage transformer 2, it is possible to prevent the transformer from biased magnetization caused by on-time asymmetry of the switching elements without the need to provide a capacitor for protecting the transformer from biased magnetization to the primary side of the high voltage transformer 2. Regarding the output voltage of the secondary winding Ns, even during the unlighted period of the discharge lamp 3, distortion and asymmetry of the output waveform of the high-voltage transformer 2 can be reduced to thereby provide an output with a substantially sinusoidal waveform, by virtue of the resonance circuit formed on secondary side of the high voltage transformer 2.

Next, description will be made of operations of the discharge lamp 3 during its lighted period. After the discharge lamp 3 has been lighted, the output of the inverter element 11 of the frequency changing means 25 is reduced to a Low level by the feedback voltage signal 19*a* that has been converted from the lamp current IL by the lamp current detection resistor 19, thereby entering the transistor 12 into an off-state. As a result, only the resistor 14 is connected to the triangular wave generation circuit 15, and the frequency of the triangle wave 15*a*, which is determined from the resistance of the first resistor 14 and the capacitance of the capacitor 26, is switched to a frequency lower than the above-described frequency during unlighted period. In this embodiment, the frequency of the triangle wave 15*a* at this time is set to a frequency (hereinafter denoted "fo'") around the frequency at which the phase difference between voltage and current on the primary side of the high-voltage transformer 2 becomes minimum. The high-voltage transformer 2 operates with good power efficiency at a frequency within a range where the phase difference between voltage and current on the primary side is small, and it is known that that frequency is included in a region lower than the series resonance frequency fss. In the present embodiment, the frequency fo' may be set, for example, to a frequency such that the phase difference ranges between 0 to −30 degrees.

Also, during the lighted period of the discharge lamp 3, the transistor 20, to which the feedback voltage signal 19*a* is applied via the diode D1, enters an on-state, and therefore the error amplifier 7 for open circuit voltage setting stops its operation. Here, the PWM circuit 6 compares the triangle wave 15*a* from the triangular wave generation circuit 15 with the output voltage 8*a* from the error amplifier 8 for lamp current setting, and based on the comparison result, outputs the pulse signal 6*a* to the logic circuit 5. Then, each of the switching elements constituting the switching circuit 4 is subjected to on-off control by the gate signals 5*a* outputted from the logic circuit 5, thereby driving the primary side of the high-voltage transformer 2.

Here, the feedback voltage signal 19*a* is fed back to the inverting input terminal of the error amplifier 8, and the error amplifier 8 outputs a voltage 8*a* according to an error between the feedback voltage signal 19*a* fed back to the inverting input terminal of the error amplifier 8 and the reference voltage Vref inputted to the non-inverting input terminal thereof. Thus, the PWM circuit 6 modulates the pulse width of the pulse signal 6*a* according to the lamp current IL, thereby performing the constant current control of the discharge lamp 3.

Furthermore, the protection circuit 10 incorporates a comparator circuit (not shown), and if a transformer current detection signal 9*a* from a transformer current detection resistor 9 provided on the lower-voltage side of the high-voltage transformer 2 is higher than the reference voltage of the comparator circuit, the logic circuit 5 is made to stop its operation, thereby preventing the flowing of an overcurrent into the discharge lamp 3 and the application of an overvoltage to the high-voltage transformer 2. The output voltages 7*a* and 8*b* of the error amplifiers 7 and 8 are also applied to the protection circuit 10 and compared with the reference voltage of the comparator circuit as well, and if the output voltages 7*a* and 8*b* exceed the reference voltage, the logic circuit 5 is made to stop its operation.

Figure 4:
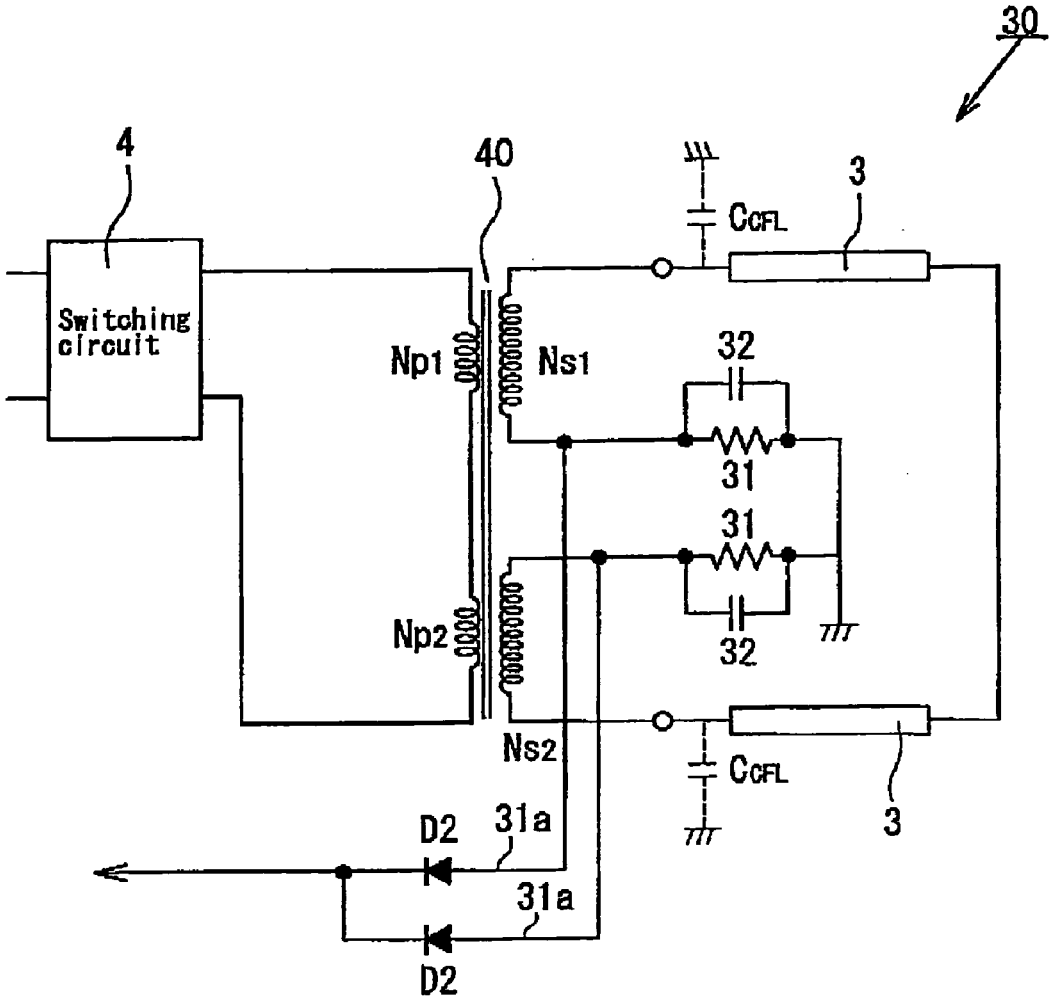
FIG. 4 is a circuit block diagram showing a discharge lamp lighting apparatus according to a second embodiment of the present invention.

FIG. 4 is a circuit block diagram showing a main portion of a discharge lamp lighting apparatus 30 according to a second embodiment of the present invention. The discharge lamp lighting apparatus 30 according to this embodiment is different from the above-described discharge lamp lighting apparatus 1 according to the first embodiment only in the structure of the high-voltage transformer 2 portion, and herein, repetitive description is omitted from description.

Figure 5:
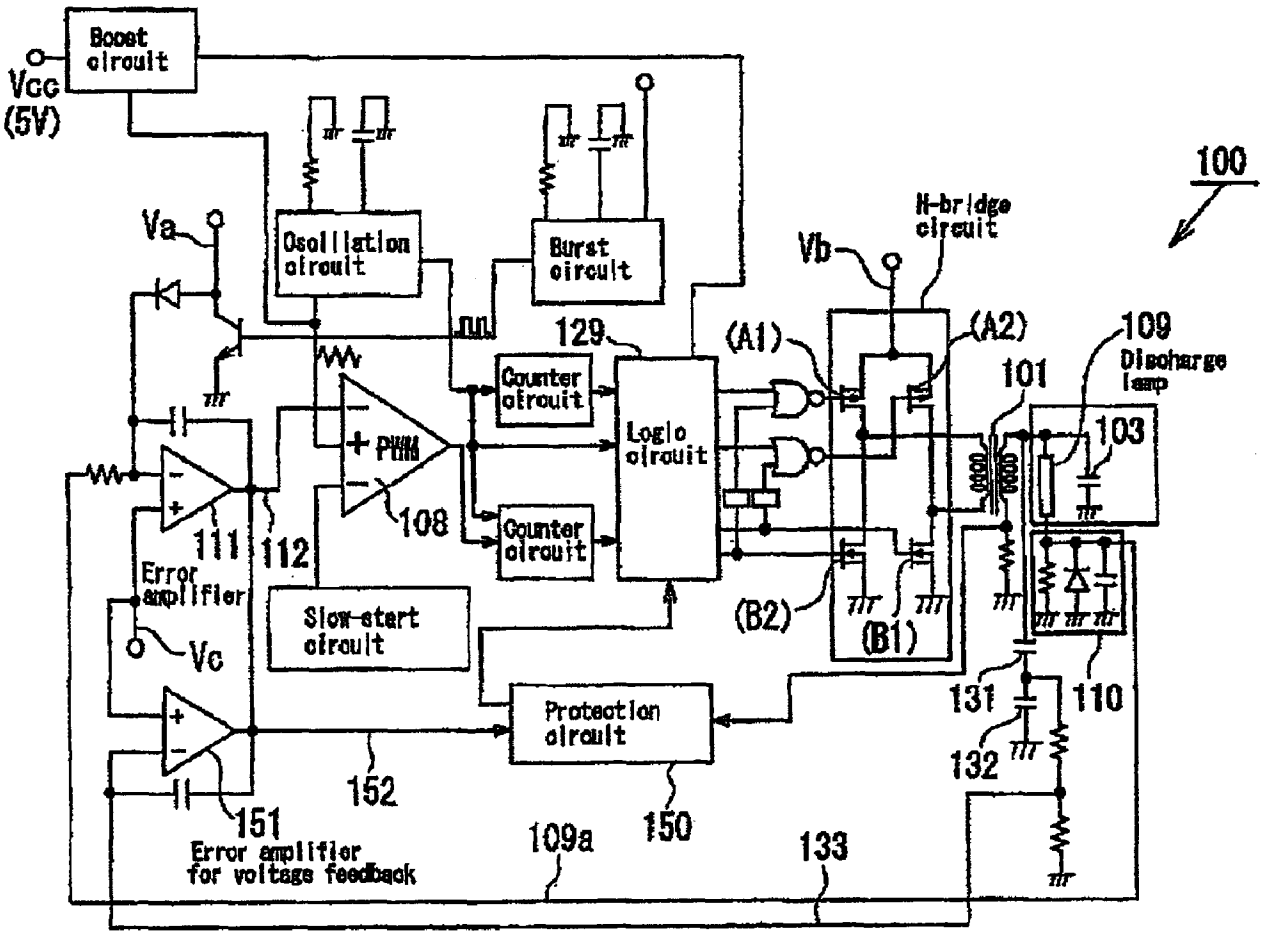
FIG. 5 PRIOR ART
FIG. 5 is a circuit block diagram showing a conventional discharge lamp lighting apparatus.

The discharge lamp lighting apparatus 30 according to the present embodiment is suitably applied to the case where two discharge lamps 3 are connected. In the discharge lamp lighting apparatus 30, a high-voltage transformer 40 has two primary windings Np1 and Np2 connected to each other in series, and has two secondary windings Ns1 and Ns2 separated from each other. Here, one terminal of each of the secondary windings Ns1 and Ns2 is connected to one terminal of a respective one of the two discharge lamps 3, and the other terminals of the secondary windings Ns1 and Ns2 are connected to the ground GND via respective resistors 31. A capacitor 32 is connected in parallel to each of the resistors 31, and respective other (lower voltage side) terminals of the discharge lamps 3 are connected to each other. $C_{CFL}$ shown in FIG. 5 is a parasitic capacitance of the discharge lamp 3. Lamp currents flowing in the discharge lamps 3 are converted into feedback voltage signals 31*a* by the resistors 31, and are inputted to the transistor 20, the error amplifier 8 for lamp current setting, and the frequency changing means 25, which are illustrated in FIG. 1.

In the construction shown in FIG. 4, the two straight tube shaped discharge lamps 3 are connected to each other in series, but the present invention is not limited to this construction. In the discharge lamp lighting apparatus 30 according to the present embodiment, one discharge lamp having a shape of a bent tube, such as a U-shaped tube or a square U-shaped tube may be connected to the high-voltage transformer with each of the terminals of the discharge lamp connected to a respective one of the secondary windings Ns1 and Ns2. Also, in the construction shown in FIG. 4, the serial connection portion between the two discharge lamps 3 may be grounded to GND. Moreover, the primary winding of the high-voltage transformer 40 may be constituted of one winding, or may be arranged so that the two windings Np1 and Np2 are connected to each other in parallel.

The invention claimed is:

1. A discharge lamp lighting apparatus comprising a high voltage transformer with a discharge lamp connected to a secondary side thereof, a switching circuit performing a switching operation based on a frequency of a triangular wave outputted from a triangular wave generation circuit so as to drive a primary side of the high voltage transformer, and a resonance circuit formed on the secondary side of the high voltage transformer in which its capacitance component is constituted of only a parasitic capacitance, wherein:

the switching circuit in pre-lighting of the discharge lamp is made to perform switching operations at a frequency around a series resonance frequency of the resonant circuit on the secondary side;

the switching circuit in post-lighting of the discharge lamp is made to perform switching operations at a frequency around which a phase difference between voltage and current on the primary side becomes minimum;

a symmetric signal is inputted into the switching circuit based on a signal produced by the triangular wave generation circuit and a symmetric rectangular wave voltage is outputted from the switching circuit;

the triangular wave generation circuit is connected to a frequency changing means provided with a capacitor and a frequency switching means including a transistor, a first resistor, a second resistor connected in parallel to the first resistor and connected to a collector of the transistor and an inverter element connected to a base of the transistor, and the frequency of the triangular wave generation circuit is adjusted by the capacitor and the first and second resistors;

the frequency of the triangular wave outputted from the triangular wave generation circuit in an unlighted period of the discharge lamp is determined by a capacitance of the capacitor and a combined resistance of the first and second resistors; and the frequency of the triangular wave outputted from the triangular wave generation circuit in a lighted period of the discharge lamp is determined by the capacitance of the capacitor and a resistance of the first resistor.

2. The discharge lamp lighting apparatus according to claim 1, further including an error amplifier for setting an open circuit voltage, wherein, on a basis of a power source voltage inputted into the error amplifier and a predetermined reference voltage, an output voltage of the high voltage transformer at a time when the secondary side thereof is open, is controlled.

3. The discharge lamp lighting apparatus according to claim 1, wherein the switching circuit is either a full bridge circuit or a half bridge circuit.

4. The discharge lamp lighting apparatus according to claim 1, wherein the series resonance frequency of the resonant circuit on the secondary side of the high voltage transformer is determined from a leakage inductance of a secondary winding and the parasitic capacitance.

5. The discharge lamp lighting apparatus according to claim 1, wherein the discharge lamp is a cold cathode lamp.

6. The discharge lamp lighting apparatus according to claim 1, wherein the discharge lamp lighting apparatus is used for a backlight device for use in a liquid crystal display device.

* * * * *